US011132925B2

(12) United States Patent
Myren-Manbeck

(10) Patent No.: US 11,132,925 B2
(45) Date of Patent: Sep. 28, 2021

(54) MODULAR APPARATUS AND SYSTEM FOR ARTISTIC EXPRESSION

(71) Applicant: Lori Myren-Manbeck, Eding, MN (US)

(72) Inventor: Lori Myren-Manbeck, Eding, MN (US)

( * ) Notice: Subject to any disclaimer, the term of this patent is extended or adjusted under 35 U.S.C. 154(b) by 0 days.

(21) Appl. No.: 16/799,276

(22) Filed: Feb. 24, 2020

(65) Prior Publication Data

US 2021/0082324 A1 Mar. 18, 2021

Related U.S. Application Data

(60) Provisional application No. 62/900,413, filed on Sep. 13, 2019.

(51) Int. Cl.

| | |
|---|---|
| ***G09F 23/00*** | (2006.01) |
| ***G09F 21/02*** | (2006.01) |
| ***D06Q 1/00*** | (2006.01) |
| ***A41D 1/00*** | (2018.01) |
| ***A41D 27/08*** | (2006.01) |

(52) U.S. Cl.

CPC ..... *G09F 23/00* (2013.01); *A41D 1/00* (2013.01); *A41D 27/08* (2013.01); *D06Q 1/00* (2013.01); *G09F 21/02* (2013.01); *G09F 21/023* (2020.05)

(58) Field of Classification Search

CPC ..... G09F 23/00; G09F 21/02; G09F 21/023; A41D 27/08

See application file for complete search history.

(56) References Cited

U.S. PATENT DOCUMENTS

| | | | | |
|---|---|---|---|---|
| 2,936,460 | A * | 5/1960 | Jackson | A41D 27/08 40/586 |
| 4,999,848 | A * | 3/1991 | Oney | A41D 1/04 2/115 |
| 5,086,516 | A * | 2/1992 | Baxter | A41D 27/08 2/108 |
| 5,943,698 | A * | 8/1999 | Blanks | G09F 21/02 2/115 |
| 10,327,488 | B2 * | 6/2019 | Chumbier | A41D 1/06 |
| 2009/0158490 | A1 * | 6/2009 | White | A41D 27/08 2/69 |
| 2012/0137399 | A1 * | 6/2012 | Forte | A47G 1/0616 2/69 |

(Continued)

*Primary Examiner* — Gary C Hoge

(74) *Attorney, Agent, or Firm* — Michael L. Greenberg, Esq.; Greenberg & Lieberman, LLC

(57) ABSTRACT

A system and apparatus configured to facilitate artistic expression across a variety of wearable and stationary mediums is described. The system employs framing elements which are disposed within a portion of a variety of wearable items such as T-shirts, backpacks, dresses, jean jackets, and others, as well as stationary items such as wall frames and standalone frames. The framing elements are equipped with retaining members which are configured to comfortably retain at least one design element in the desired location. Design elements can easily be removed and swapped out, or may simply be displayed elsewhere. Design elements may be made of a variety of eco-friendly materials, and the articles themselves are preferably consciously made for the benefit of the environment. The system serves to replace countless T-shirts with the capacity to change the appearance of a shirt or other article easily at will.

4 Claims, 10 Drawing Sheets

(56) References Cited

U.S. PATENT DOCUMENTS

| | | | | |
|---|---|---|---|---|
| 2012/0216326 | A1* | 8/2012 | Van Kuren | A41D 27/08 2/69 |
| 2013/0104289 | A1* | 5/2013 | Kateraas | A41D 27/08 2/243.1 |
| 2013/0145522 | A1* | 6/2013 | da Silva | A41D 27/08 2/244 |
| 2013/0239295 | A1* | 9/2013 | Villegas | A41D 27/08 2/244 |
| 2014/0044909 | A1* | 2/2014 | Shi | G09F 21/02 428/41.7 |
| 2014/0044910 | A1* | 2/2014 | Shi | B32B 7/12 428/41.7 |
| 2014/0082817 | A1* | 3/2014 | Kempe | A45F 5/02 2/69 |
| 2014/0150157 | A1* | 6/2014 | Perry | A41D 11/00 2/69 |
| 2015/0371565 | A1* | 12/2015 | Urbano | G09F 21/02 2/252 |
| 2017/0099885 | A1* | 4/2017 | Levy | A41B 1/18 |
| 2018/0116314 | A1* | 5/2018 | King | A41D 27/08 |
| 2019/0311659 | A1* | 10/2019 | Mahan | G09F 23/00 |
| 2019/0318214 | A1* | 10/2019 | Woolf | A63K 3/00 |

* cited by examiner

MODULAR APPARATUS AND SYSTEM FOR ARTISTIC EXPRESSION

FIELD OF THE PRESENT INVENTION

The present invention relates to the field of artistic expression, and more specifically relates to a new apparatus and system configured to facilitate the exhibition of art and similar design elements in a multitude of mediums, including both wearable items and stationary items, for use by users wishing to have a range of options pertinent to his/her desired method of expression.

BACKGROUND OF THE PRESENT INVENTION

T-shirts were originally introduced in 1868, under the name "Union Suit" because they were worn mostly by union workers. They started out as one-piece flannel garments, now often referred to as "long johns." By the 1900's, they were redesigned to include only the shirt and became a mainstay in US Navy uniforms, spreading from there to other branches of the military. When soldiers returned from service, they brought the shirts with them. At first worn only as undergarments, t-shirts crossed into outerwear after World War II. Since that time, they have become a mainstay of most wardrobes.

In the 1950's, in part thanks to Marlon Brando sporting graphic t-shirts in A Streetcar Named Desire, t-shirts transformed from articles of practical clothing to fashion. As more diverse messages were added, t-shirts became an inexpensive and fun way to express feelings, share humor, or make a statement.

Over time, various designers have printed images of art on shirts. Although this medium allowed sharing of these images, the art never really looked like art. Instead, it looked like art printed on t-shirts. If an artist wanted to create a unique and special t-shirt that really looked like art, they had to work one shirt at a time, with the result that the art and the shirt would have one static use.

For messages, art, and design, the guide has been one t-shirt, one graphic. While having many t-shirts and many messages is fun, it has also become increasingly problematic. Closets and drawers are filled with t-shirts, many of which are made of inexpensive material that never biodegrades and leaves a long and ugly footprint on the earth. Landfills are full of shirts. There has also never been a way for art to go from the wall to a shirt to a bag, allowing the user a variety of vehicles with which to share the art. If there were a way in which a design element could be exchanged with a different design element while using the same t-shirt (backpack, purse, or other mobile medium), people would purchase fewer shirts, but have more freedom of expression.

Thus, there is a need for a new form of interchangeable T-shirt/item artistic expression system which is configured to accept a variety of artistic design elements which may be exchanged at will by the wearer, or may be moved to other mediums such as bags, jackets, sweaters, picture frames, and other similar items. Such a system preferably employs a panel-based system by which artistic design elements are removably affixed to a T-shirt or other wearable (bags, overalls, jackets, sweaters, etc.) via one or more retaining holders. Additionally, such a panel-based system helps to rectify the environmental waste prevalent in general T-shirt design by allowing users to continue collecting the messages and graphics that they care about while reducing the negative impact on the earth, supporting artists, and facilitating a method by which art, graphics, and messages are movable to stationary objects such as art frames or other wearable items while creating a new and fun fashion line.

Few similar products are presently found in the prior art. Some of which, while approximating some aspects of the present invention, fail to reference rapid and simple replacement of design elements, or those which take the place of several shirts, bags, and artwork. Additionally, no prior art references are found which include a vision to employ a work of art present on a wall to be easily portable to a garment or other fabric accessory. Likewise, no reference discuss use of the artistic design elements on jumpers, bags, jean jackets, shirts, and a wall or frame.

For example, US Patent No. U.S. Pat. No. 3,182,701A is for a Multiple Face Handbag. In contrast to the system and apparatus of the present invention, this application teaches the replacement of the entire surface of a handbag such that the bag is a different color.

Likewise, US Patent No. U.S. Pat. No. 5,636,385A is for a Clothing Article with Framed Hologram Applique. Unlike the system and apparatus of the present invention, this application teaches the use of plastics, and is configured for use with holograms specifically.

US Patent No. U.S. Pat. No. 2,647,261A is for a Sport Shirt Having Detachable Insignia Panel. Unlike the present invention, the apparatus taught in this application is specific to sporting shirts, and is only designed to accommodate insignias.

SUMMARY OF THE PRESENT INVENTION

The present invention is a revolutionary design that allows the use of an unlimited variety of graphics with the ownership of one basic t-shirt, one bag, one picture frame, and/or other article, and the ability to easily move the graphic from one medium to another. An object of the present invention is to provide people with articles of clothing that can be uniquely adapted to express each individual's identity or individuality. An object of the present invention is to provide people with articles of clothing that can be uniquely adapted to include stylistic, branded, artistic, and or designed customizations on both an individual and mass-manufactured bases. An object of the present invention is to provide a means to enable a person to customize his, her, or their clothing with styled, branded, artistic, and or designed elements that may be permanently applied, removably applied, or that are replaceable or relocatable in their application.

An object of the present invention is to provide an article that is further comprised of a mechanism or mechanisms that enable the permanent, removable, replaceable, or relocatable positioning of styled, branded, artistic, and or designed elements. An object of the present invention is to provide an article that is further comprised of a primary article of clothing (the primary article), a mechanism, and a design element that together accomplish at least one or one part of the above described objects of the present invention. An object of the present invention is to create more opportunities for art to be enjoyed, not just hanging or mounted on generally stationary locations or objects, but instead increasingly as worn by people.

The various components of the present invention may be comprised of nearly any material, especially those that are lightweight and may be presented as artistically striking, plain, or lighted. Such materials may include woods, plastics, metals, fibrous materials such as those that are plant or synthetic based, or carbon-fibers. Heavier materials may be applied as a veneer or as hollow extrusions, molds, or forms. They may be injection molded, 3D printed, blow molded, rotomolded, welded, machined, deposited, layered, or otherwise crafted or arranged. Such forms may contain electronics or other components that provide more sophisticated functionalities or novelties.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
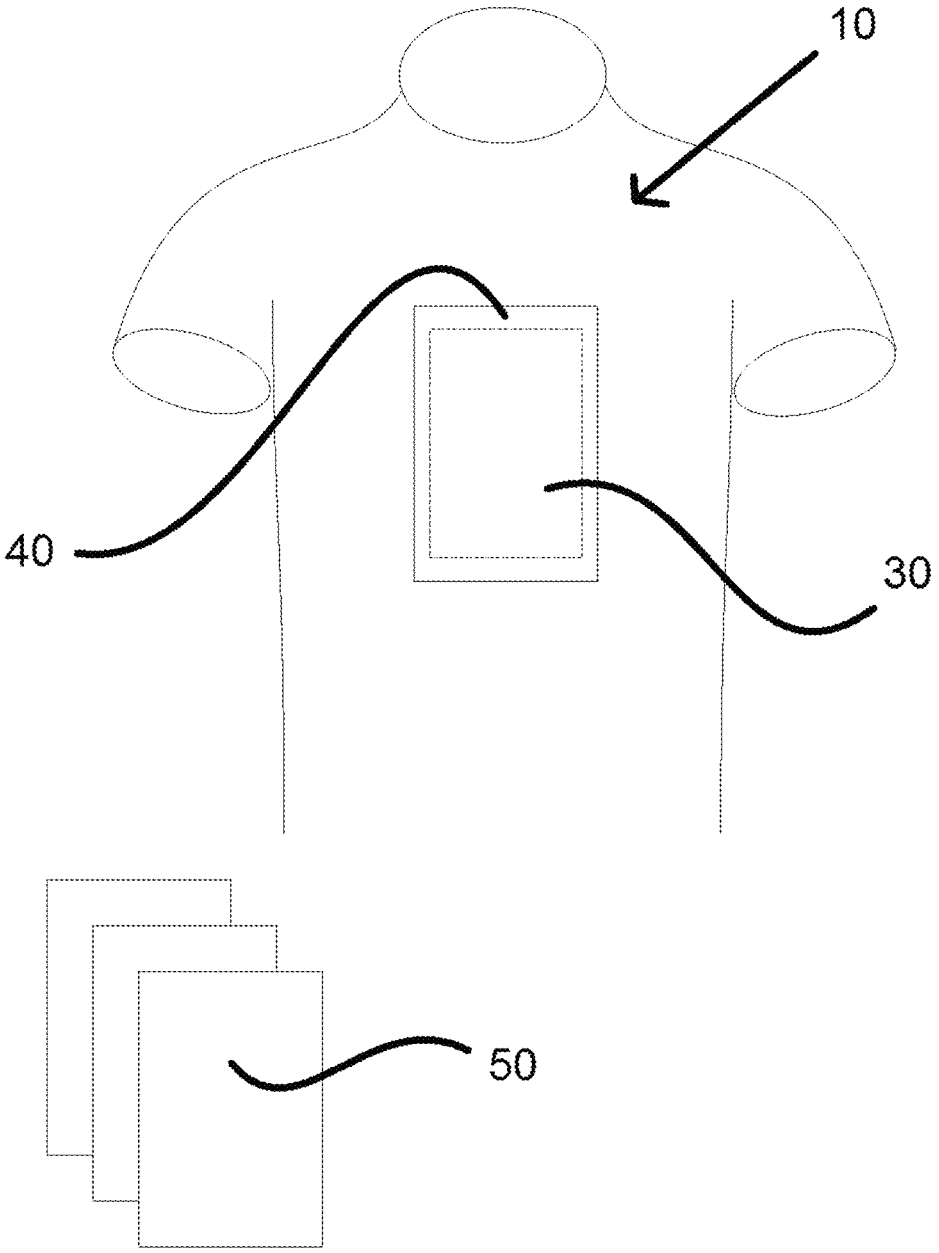
FIG. 1 depicts a view of a front of a first embodiment of the present invention.

The present invention is a modular medium for artistic expression which concentrates on the wearability and exchange of artistic design elements. The present invention includes a primary article (10), at least one retaining mechanism (20), and at least one design element (30). At least one design location (40), equipped with at least one retaining mechanism (20) is configured to accept at least one design element on the primary article (10) as shown in FIG. 1.

Optionally, design element (30) may be replaced with another design element from a group of compatible design elements (50). Optionally, at least one design element (30) and one or more design elements from a group of design elements (50), or one or more design elements from a differing group of design elements (50) may be added together to be introduced in at least one design location (40) on any given primary article (10). It should be noted that the snaps are preferably invisible from the front of the design element (50) when affixed to the primary article (10), however a designer may wish to make the top of the female snap visible from the front of the primary article (10) if desired.

Figure 2A:
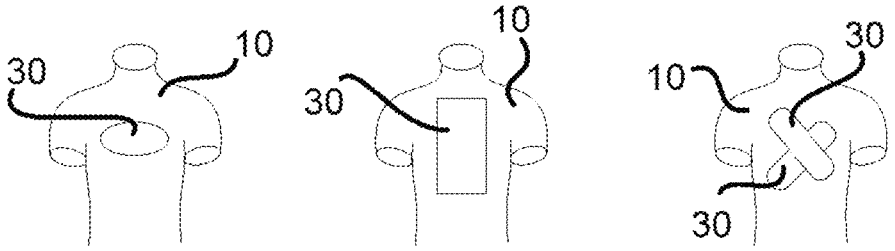
FIG. 2A exhibits a view of a front of a second embodiment of the present invention, exhibiting different shapes of design elements disposed within a T-shirt.
Figure 2B:
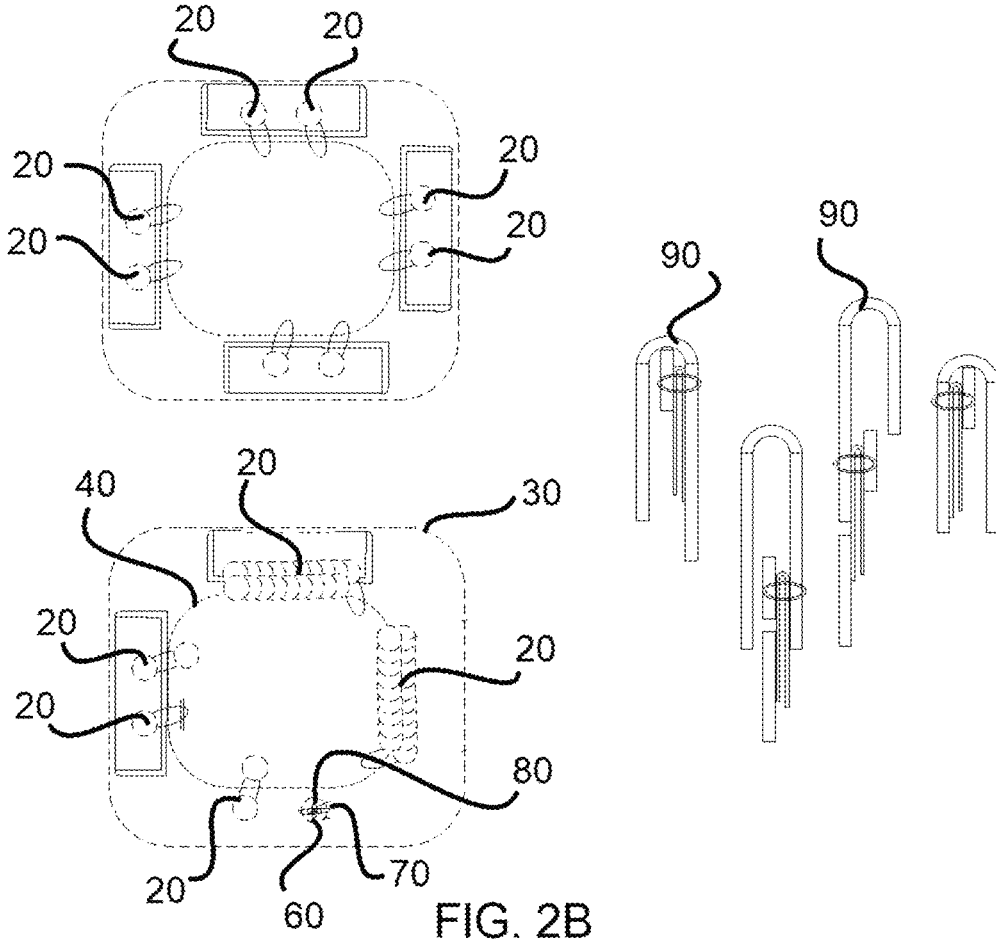
FIG. 2B depicts an assortment of retaining mechanisms, including buttons, zippers, and loop/buttons which may be present on various embodiments of the present invention.
Figure 2C:
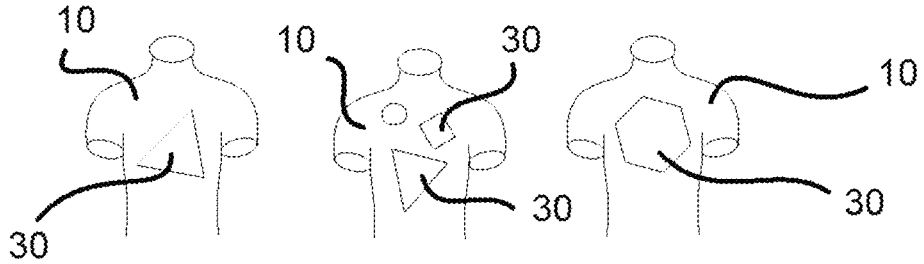
FIG. 2C shows differing shapes and numbers of design elements in place on a T-shirt equipped with the system of the present invention.

As shown in FIG. 2, the at least one retaining mechanism (20) may be one or more of the following mechanisms: buttons and loops, buttons and button-holes, snaps, and zippers. Per FIG. 2B, a button (60) and button-hole (70) are configured with a cross-stitch and hole pattern (80) therebetween in order to enable a design element (30) to be releasably attached to the primary article (10) in a design location (40). Similarly, with the use of snaps as the at least one retaining mechanism (20), a conventional male/female snap combination is preferably provided, with one portion of the snap combination adhered to the design element (50), and the opposite corresponding second portion of the snap combination adhered to the primary article (10).

Figure 7:
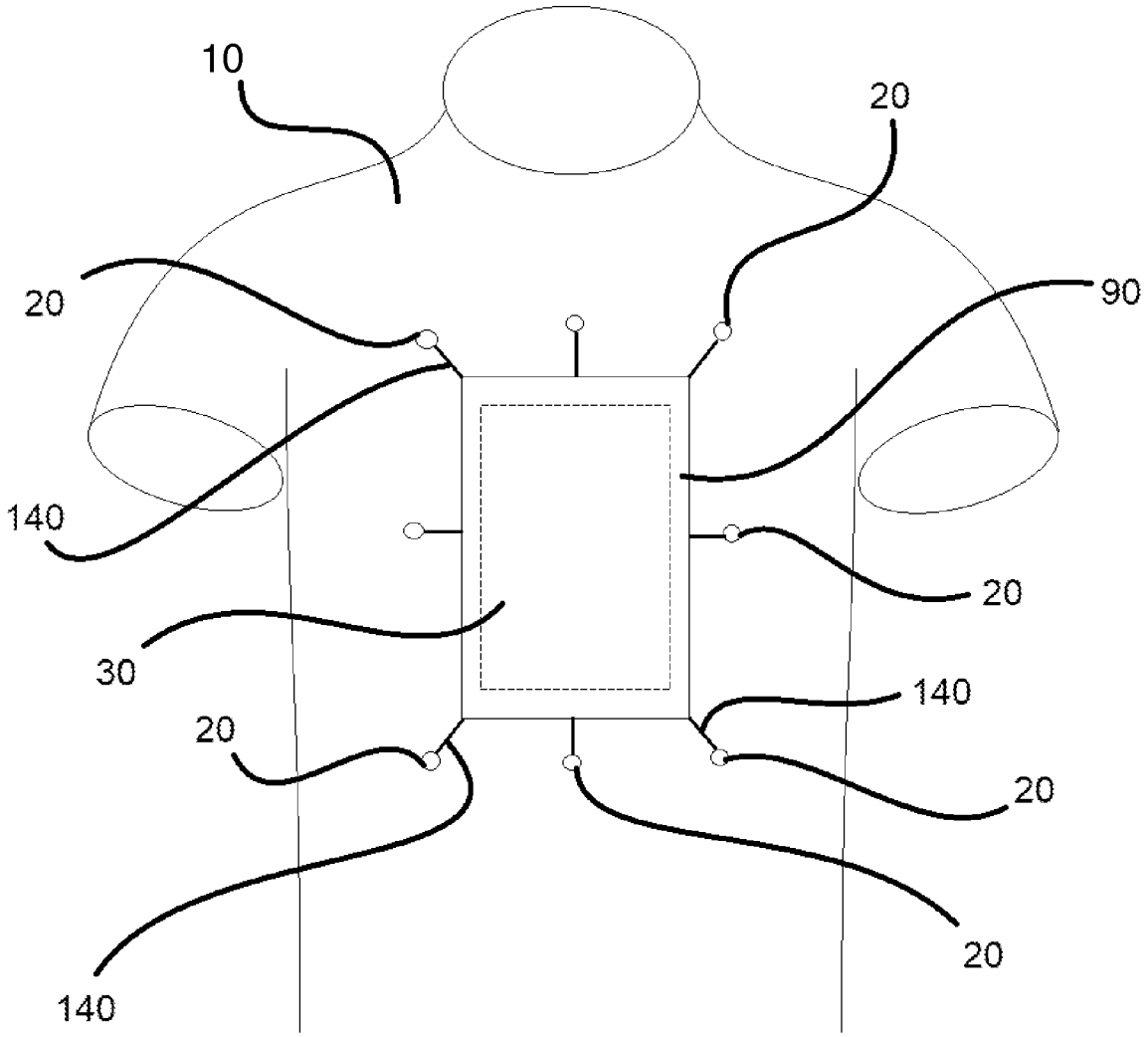
FIG. 7 exhibits a front view of a seventh embodiment of the present invention which details the use of external attachment mechanisms such that they are visible on the outside of the primary article.

Furthermore, the retaining mechanisms (20) may be adapted such that a framing element (90) or framing elements, may be incorporated between the primary article (10) and the design element (30) alternately in a way where the retaining mechanisms (20) are invisible or where the retaining mechanisms (20) are visible. As seen in FIG. 7, embodiments of the present invention which exhibit visible retaining mechanisms (20) may employ the use of hemp cord (140) to facilitate attachment of the retaining mechanisms (20) to the framing element (90) and or design element (30).

Additionally, in some embodiments, the framing element (90) or elements may fold over the retaining mechanism (20) or may be sized as to not fold over the retaining mechanism (20), but instead to strengthen the efficacy of the retaining mechanism (20) and primary article (10) so that the weight of the design element (30) may be carried by the primary article (10) without distorting, pulling, disturbing, or interfering with the way the primary article (10) is designed to appear and carry the design element (30). Further, the framing element (90) may be discontinuously (as shown) or continuously (not shown) arranged around the periphery of, or within, the design location (40). It should be noted that the framing element (90) may be ironed, before or after the design element (30) has been attached to support the in-place carrying of the design element (30). Alternately, in certain novelty applications (not shown), it is desirable that the design article does distort, pull, disturb, or interfere with the way the primary article (10) interfaces with the design element (30), which may dynamically adjust with movement.

Figure 3:
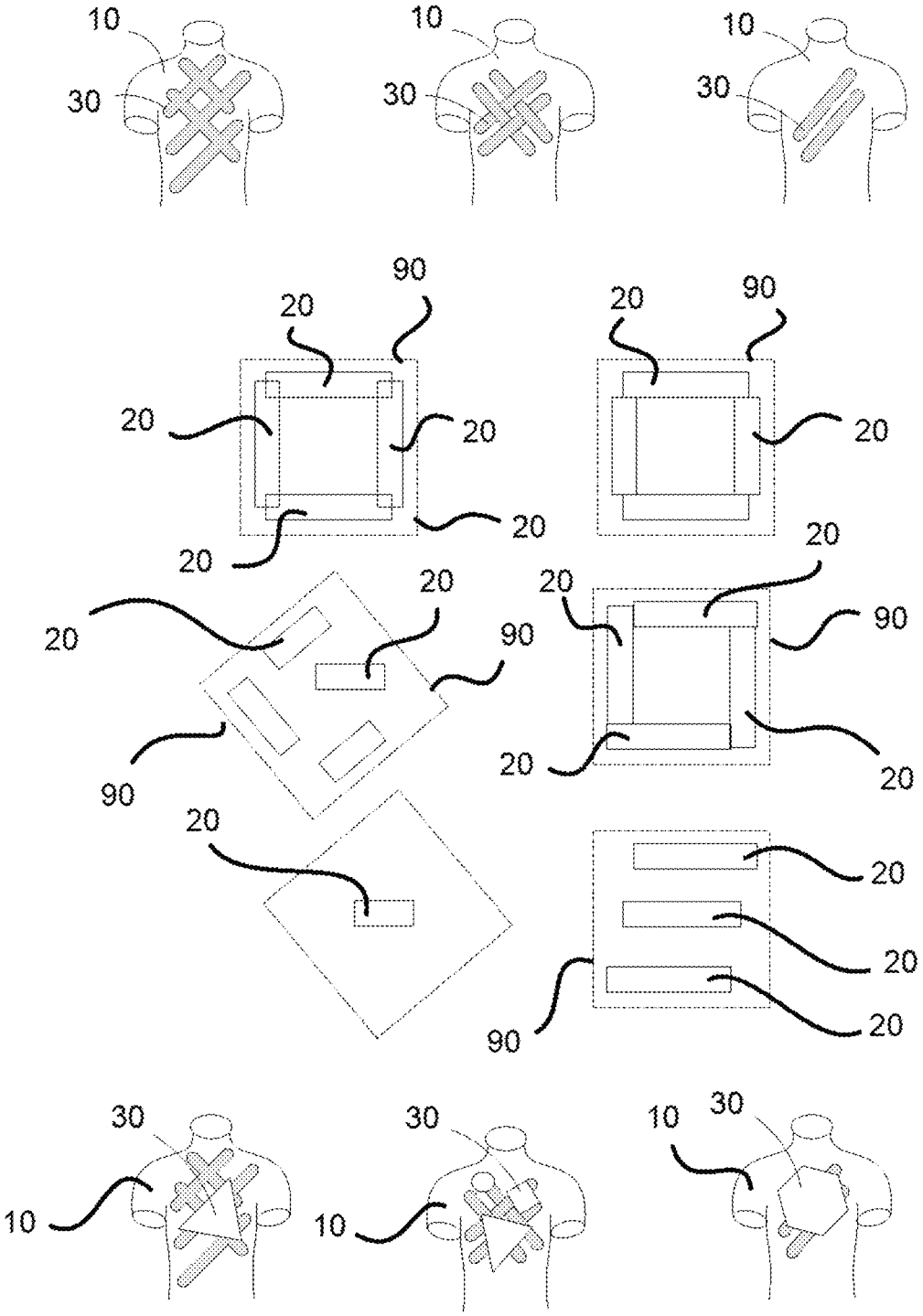
FIG. 3 displays a view of a front of a third embodiment of the present invention, detailing a variety of design elements and retaining mechanisms in use by the system.

As presented in FIG. 3, the retaining mechanisms (20) that are generally arranged and depicted may include, but are not limited to: hook and loop re-closable fasteners, post and cap re-closable fasteners, and generally attractive materials such as those that attract or attach using adhesive, magnets, static cling, atmospheric pressure, Van Der Waals forces, or any other means of attraction or contextual compatibility. It should be noted that the retaining mechanisms (20) of most embodiments may be adapted such that the design element (30) may be positioned in such a fashion that the retaining mechanisms (20) are invisible or are visible to an outside observer.

Figure 4:
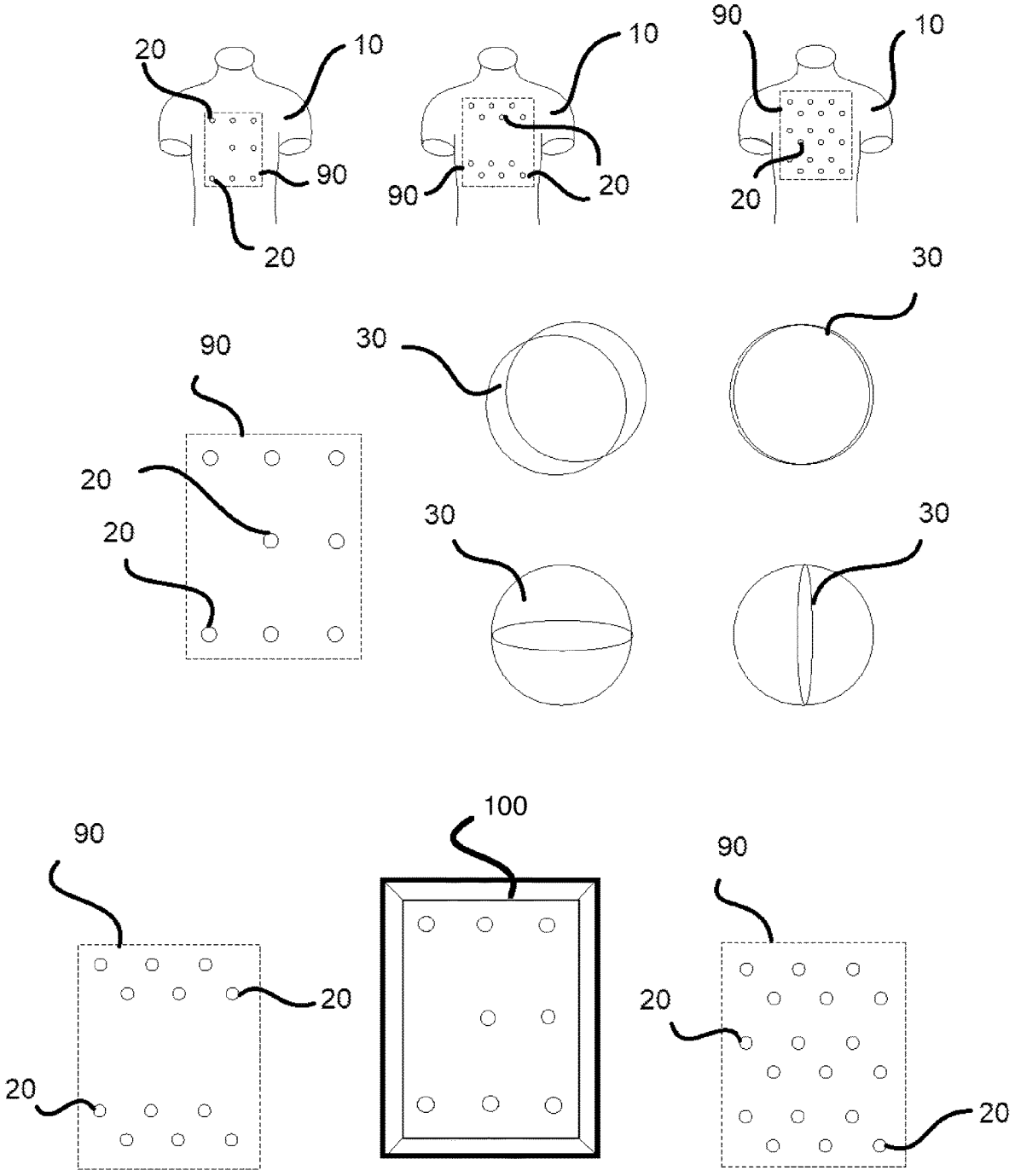
FIG. 4 shows a view of a front of a fourth embodiment of the present invention, and details a variety of three-dimensional design elements, as well as differing forms of placement of retention mechanisms present on some embodiments of the present invention.

As disclosed in FIG. 4, various embodiments of the design location (40) configured to accept one or more design elements (30) are equipped with varying numbers of retaining mechanisms (20) by which the design element(s) (30) are adhered to the primary article (10) in these cases, a T-shirt. Additionally, a frame embodiment (100) is disclosed, which is configured to be stationary, similar to a conventional canvas or picture frame, to which the design element (30) may be affixed and admired when not worn on a T-shirt, bag, or other primary article (10).

It should be understood that artistic design elements (30) may be one or more of a variety of sizes, having a multitude of dimensions in various embodiments of the present invention. In some embodiments the design elements (30) may be configured to wrap around one or more sides of the primary article (10). Common sizes of some design elements (30) configured to fit in some embodiments of the framing element (90) include, but are not limited to 10 inches by 12 inches, 12 inches by 14 inches, and 13 inches by 16 inches. Other sizes include 10 inches by 10 inches, 12 inches by 12 inches, and 12 inches by 6 inches. It is envisioned that different shapes of framing elements (90) are preferably available to accommodate differing shapes of design elements, including, but not limited to circles, hexagons, trapezoids, parallelograms, triangles, and other conventional shapes. It is envisioned that primary sizes are semi-standardized in order to easily facilitate the transfer of design elements (30) from one medium (primary article (10)) to another (such as a wall-mounted frame, backpack, or the like).

The design element(s) (30) should be understood to be composed of a variety of eco-friendly materials, including, but not limited to: hemp, organic cotton, bamboo, or other fabrics; paint; lightweight metal; styrofoam; leather; plastic; repurposed fabrics; electronics; buttons made of eco-friendly material, such as coconut; yarn; hemp cord, soy or natural based plastics; ecofriendly styrofoam alternatives. Material for the primary article(s) (10), namely shirts, dresses, jean jackets, bags, etc., are preferably made of environmentally friendly materials including hemp, Tencel, denim, canvas, soy silk, organic cotton, organic wool, recycle fabrics, and plant-based leather (Pinatex™). It should similarly be noted that artists preferably create their own design elements (30) for use with the system and apparatus of the present invention, which may then be displayed. Some design elements (30) are preferably available directly from artists themselves, although it is envisioned that design elements (30) may be purchased from a website which exhibits a wide variety of design elements (30) from which consumers may choose quickly and easily.

Figure 6:
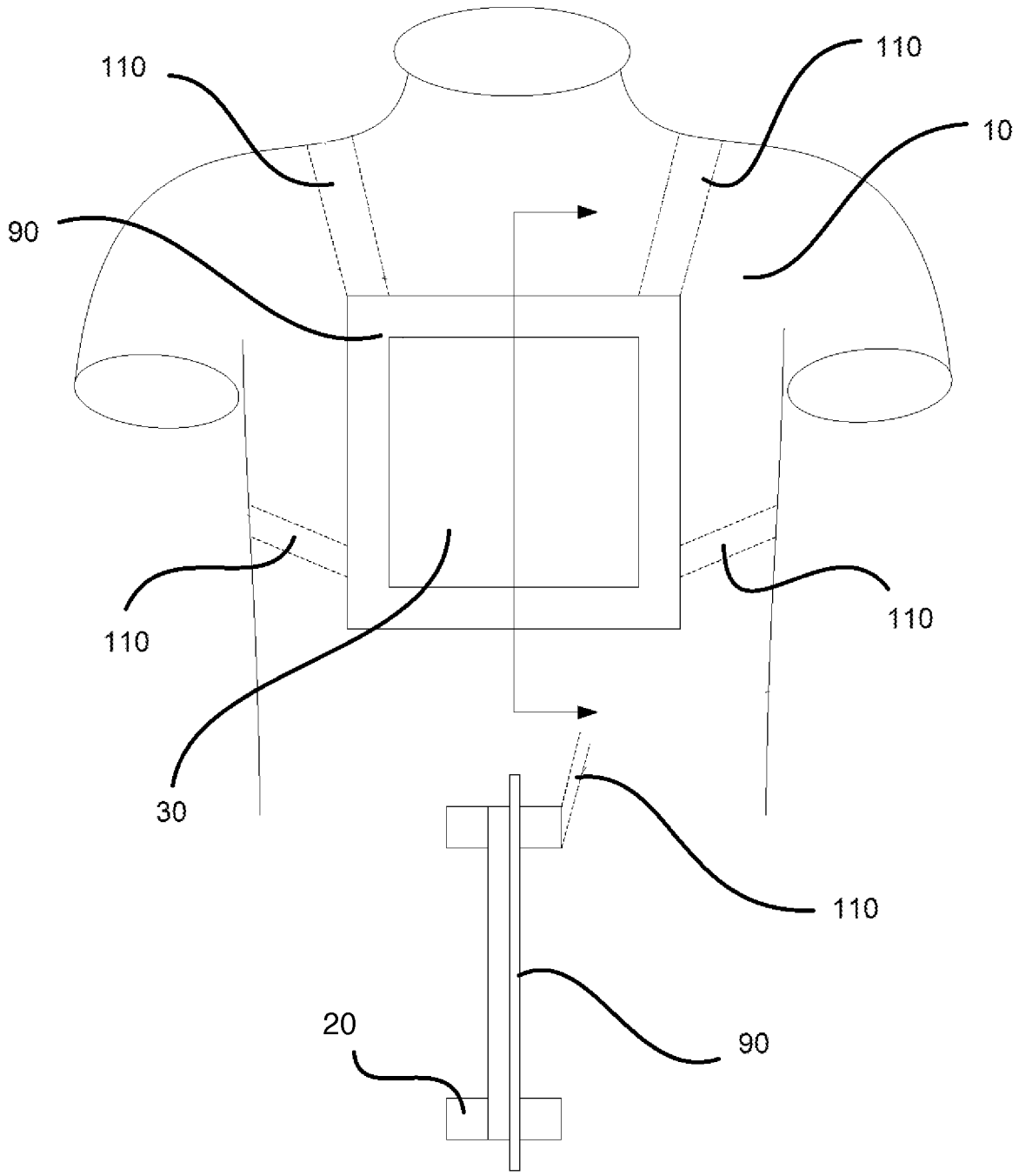
FIG. 6 shows a front and sectional view of a sixth embodiment of the present invention.
Figure 8:
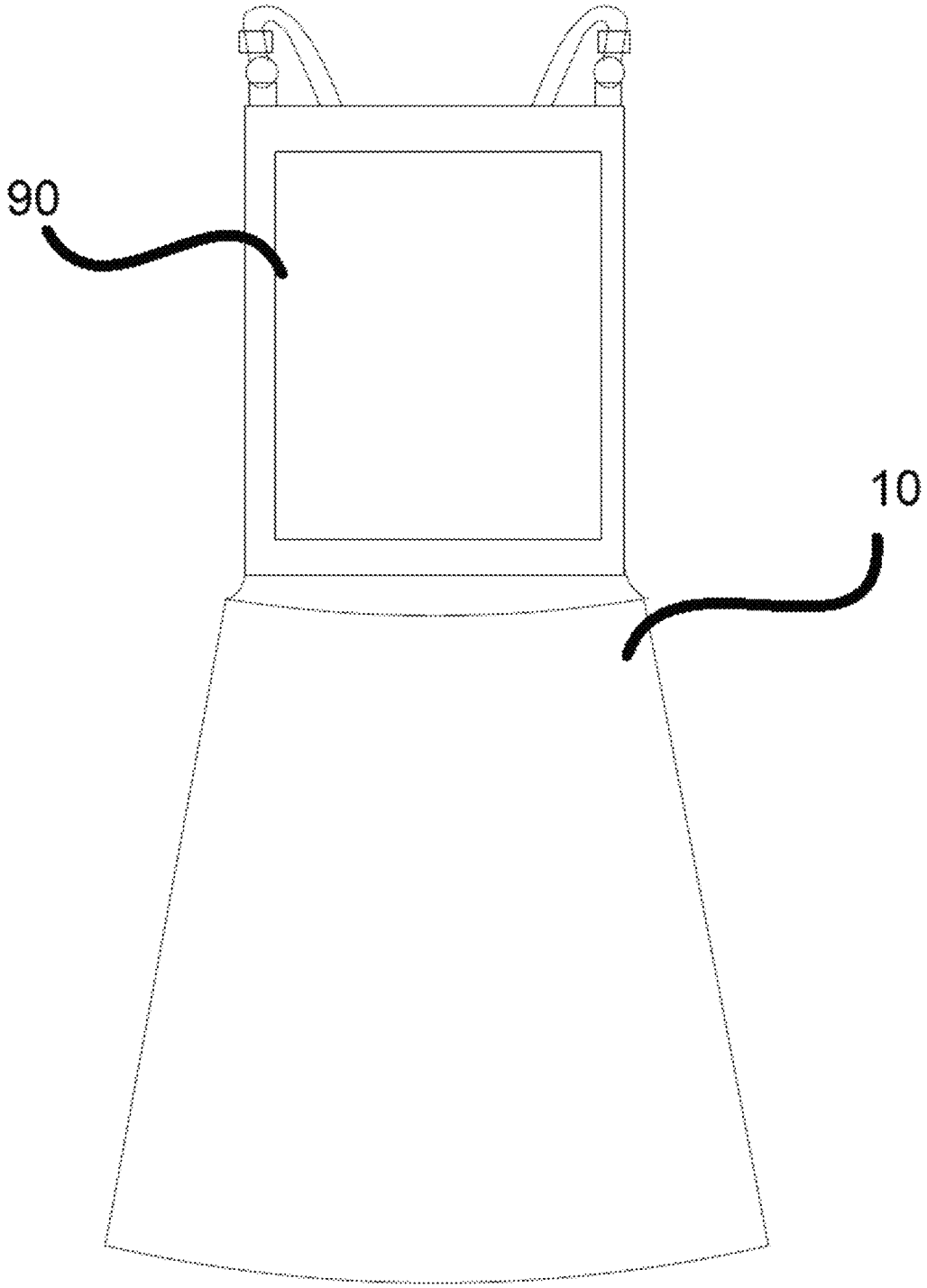
FIG. 8 depicts a front view of a jumper dress equipped with the modular artistic display platform of the present invention.
Figure 9:
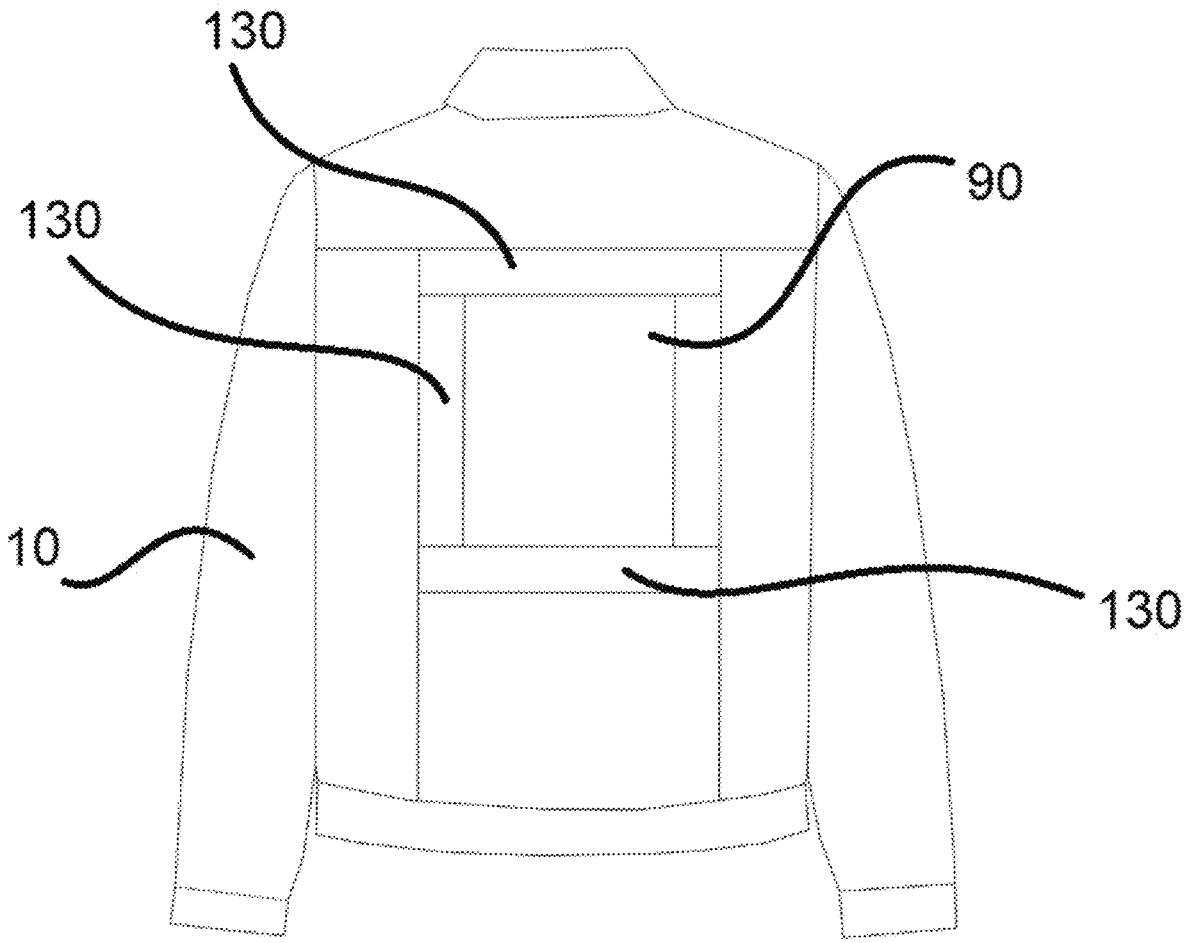
FIG. 9 depicts a rear view of a jacket equipped with the modular artistic display platform of the present invention.
Figure 10:
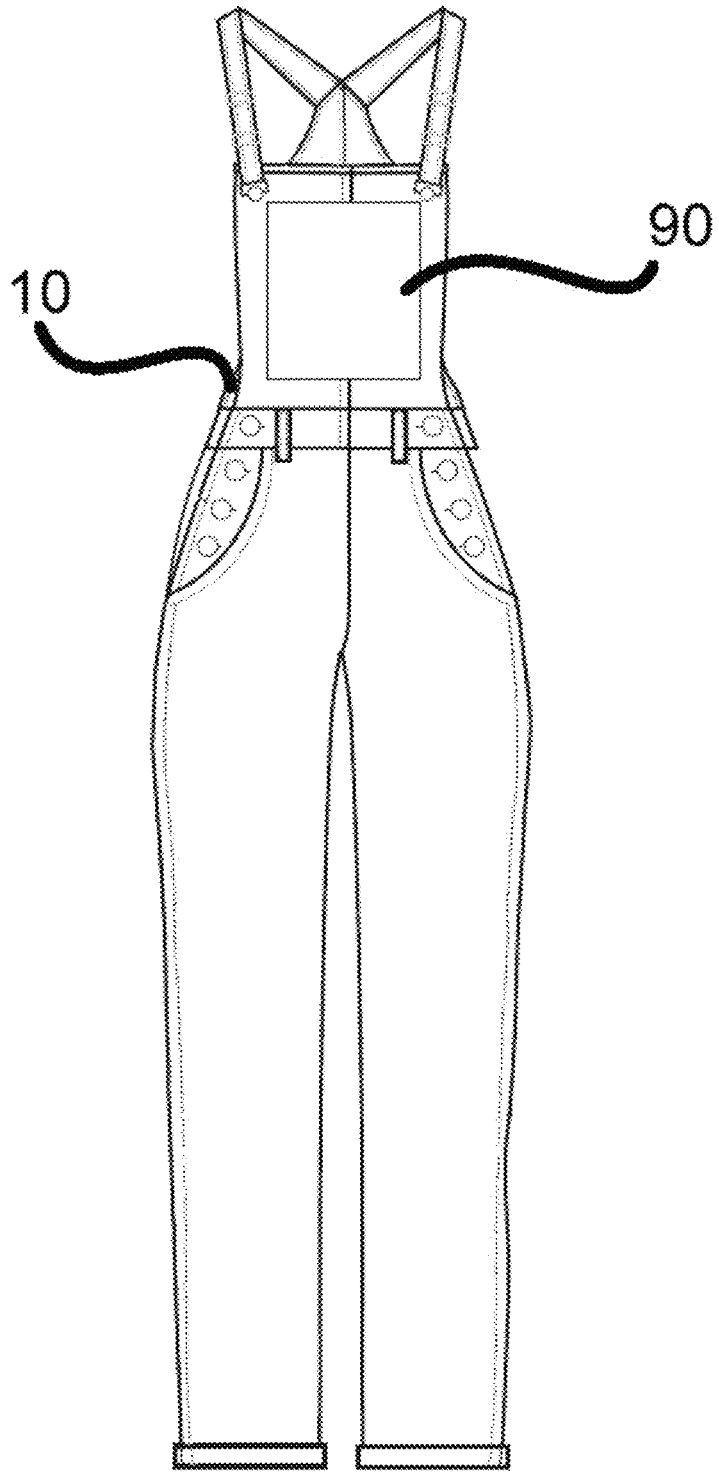
FIG. 10 depicts a front view of overalls equipped with the modular artistic display platform of the present invention.

In some embodiments of the present invention, it is envisioned that magnetic snaps and buttons may be used as retaining mechanisms (20) which are attached to the framing elements (90) which are secured to the primary articles (10). In other embodiments, such as those shown in FIG. 6, suspenders (110) may be employed to ensure adequate retention of the design element (30). For attachment of the design element (30) to a wall frame, retaining mechanisms (20) preferably include dowels configured to snap into an upper frame, hooked pegs, snaps, string of cord, or other similar attachment methods. Other embodiments are shown in FIG. 8-10 depicting the framing element (90) disposed on other primary articles (10) such as a jacket, jumper, and overalls as examples.

Figure 5:
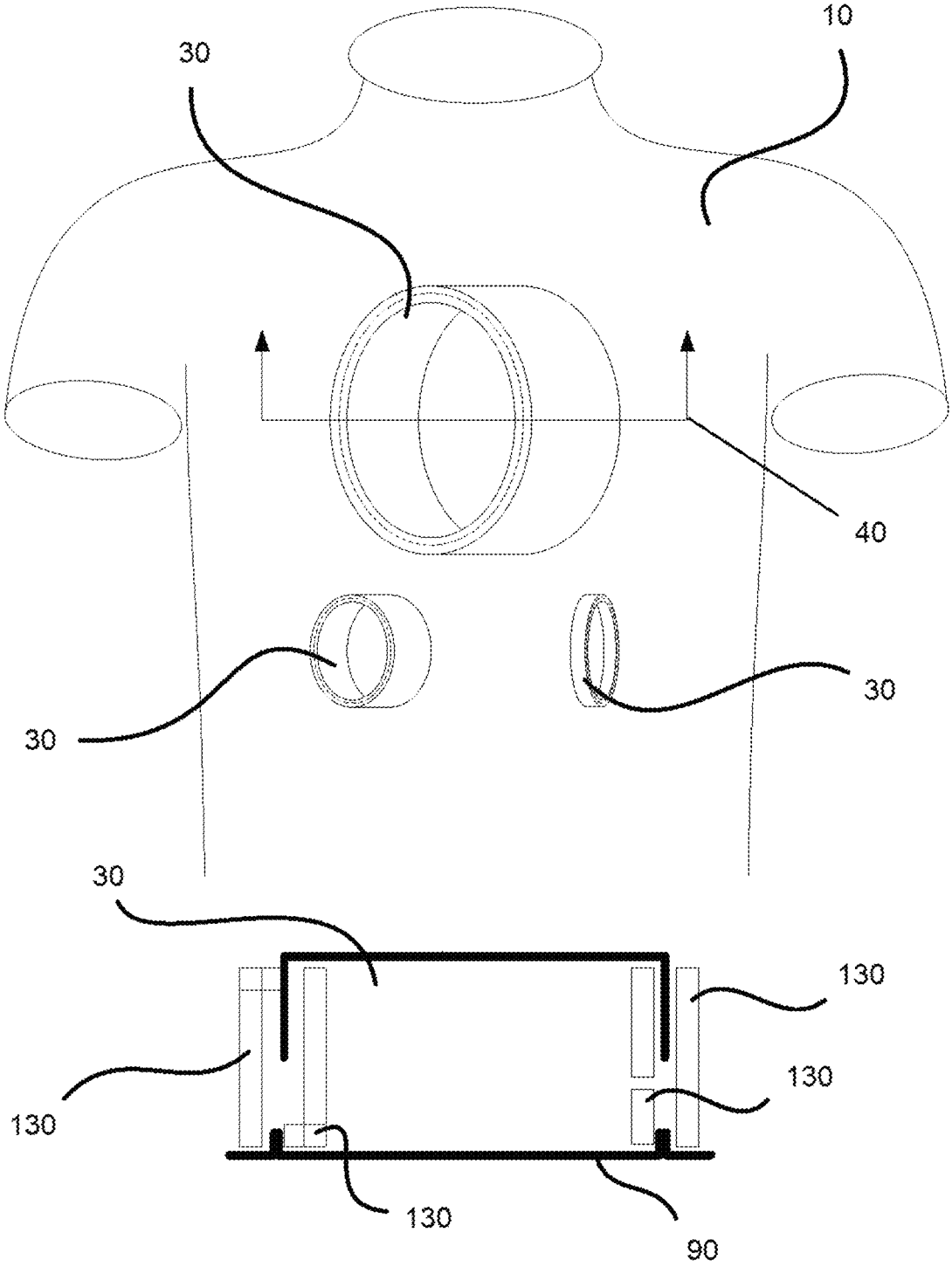
FIG. 5 depicts a front and sectional view of a fifth embodiment of the present invention.

Similarly, in some embodiments of the present invention, especially those equipped with design elements (30) configured to protrude from the predominant front plane of the primary article (10), the frame element (90) is preferably equipped with complementary retaining mechanisms (130) to provide sufficient structural support to the design element(s) (30) as shown in FIG. 5. It should be understood that the complementary retaining mechanisms (130) are preferably one or more differing forms of retaining mechanisms (20) present in other embodiments of the present invention.

It should be noted that the number of retaining mechanisms (20) necessary may vary depending on the type of retaining mechanism employed, as well as the size of the design element (30) and in some cases, the size of the primary article (10). Presently, for larger design elements (30), three retaining mechanisms (20) are disposed along the top and bottom, and four retaining mechanisms (20) disposed on the right side and left side. If the retaining mechanisms (20) are magnets, then only two may be needed per side of the design element (30).

Additionally, many of the design elements (30) may be configured to protrude from the front of the primary article (10) (such as a T-shirt), some of which may hang over the framing element (90). For example, fabric might be woven on a canvas panel (design element (30)) and have pieces that hang below. The fabric pieces will preferably have depth, and will therefore protrude out and away from the front plane of the primary article (10). If light-weight eco-friendly styrofoam alternatives are used, a structural element could also protrude. Similarly, lightweight metals, paper, and cardboard-based design elements (30) could potentially protrude as well. It should be understood that all design elements (30) are preferably fashioned of eco-friendly materials and are manufactured or constructed in an environmentally-conscious fashion.

Preferred embodiments of the present invention are preferably equipped with retaining mechanisms (20) disposed in groups such that three are present on the top, three are present on the bottom, four are disposed on the right side, and four are disposed on the left side, with the corresponding design element (30) equipped with embroidered holes which align with the retaining mechanisms (20). It should be understood, however, that alternate forms of retaining mechanisms (20) may be employed in alternate embodiments of the present invention, including buttons, snaps, Velcro™, and similar known means of attachment. Additionally, it should be noted that the modular artistic display platform and system of the present invention preferably employs earth-friendly materials in manufacturing, and is configured to enable users to enable the display of one graphic (design element (30)) in a variety of locations, and to allow one bag, jacket, T-shirt, jumper, overall, frame, or other primary article (10) to hold limitless design elements (30).

Finally, it should be understood that the system and apparatus of the present invention is envisioned as a new medium for artists to create designs that their patrons can reuse over and over in multiple varying ways. Via the system and apparatus of the present invention, a single T-shirt or bag (primary article (10)) can have multiple images attached, transforming it based on the wearer's current mood. Additionally, the system provides a method by which art, photos, messages, and logos can be moved among picture frames on the wall, shirts, bags, skirts, jackets, and other similar articles, providing increased functionality and impact. Likewise, the system and apparatus of the present invention presents an eco-friendly alternative to the current system of "one shirt" or "one bag" with a single message or artwork. Similarly, it should be noted that the present invention is a system through which nonprofits, schools, and artists can eliminate the guesswork in choosing T-shirt sizing, as well as an economical means by which businesses and organizations can share their messages. The system provides a method which encourages T-shirt designers to share their messages while reducing the environmental impact of their business.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A modular artistic display platform comprising:

a first primary article;

at least one retaining mechanism;

at least one design element, said at least one design element disposed removably in communication with said first primary article via said at least one retaining mechanism;

wherein said at least one retaining mechanism is present on four sides of said at least one design element;

wherein said at least one retaining mechanism facilitates removal and replacement of said at least one design element without tools;

a frame, said frame disposed on a wall and similarly equipped with at least one retaining mechanism;

wherein said frame is configured to hold said at least one design element in a stationary location as a display when said at least one design element is not worn on said first primary article;

wherein said at least one design element is configured to fit into said frame on the wall and is configured to be removed from said frame and attached to a second primary article; and wherein said first primary article is an item selected from the following group: a shirt, a skirt, a bag, a jacket, or a sweater.

2. The modular artistic display platform of claim 1, wherein said at least one retaining mechanism is of a type selected from the following group: hook-and-loop fasteners, snaps, buttons, post-and-cap reclosable fasteners, magnets, and temporary adhesive.

3. The modular artistic display platform of claim 2, wherein said design element is composed of a material selected from the following group: hemp, soy, natural-based plastics, organic cotton, and bamboo.

4. The modular artistic display platform of claim 3, wherein said first primary article and said second primary article are composed of a material selected from the following group: hemp, Tencel, denim, canvas, soy silk, organic cotton, organic wool, recycled fabrics, and plant-based leather.

* * * * *